US005469610A

United States Patent [19]

Courian et al.

[11] Patent Number: 5,469,610

[45] Date of Patent: Nov. 28, 1995

[54] FASTENING TOOL AND FASTENER

[76] Inventors: Curtis C. Courian, 4428 Mistral Pl.; Kenneth J. Courian, 3536 Seahorn, both of San Diego, Calif. 92130

[21] Appl. No.: 267,430

[22] Filed: Jun. 28, 1994

Related U.S. Application Data

[63] Continuation of Ser. No. 106,439, Aug. 16, 1993, abandoned.

[51] Int. Cl.[6] ..... B21J 15/04

[52] U.S. Cl. ..... 29/243.521; 29/243.53; 29/798; 227/55

[58] Field of Search ..... 29/243.521, 243.523, 29/243.52, 243.525, 243.53, 252, 254, 255, 525.2, 812.5, 798; 227/55, 58, 59, 130

[56] References Cited

U.S. PATENT DOCUMENTS

| | | | |
|---|---|---|---|
| 1,437,245 | 11/1942 | Hinchcliff . | |
| 2,593,506 | 4/1952 | Wales . | |
| 3,412,594 | 11/1968 | Lund | 29/798 |
| 3,491,578 | 1/1970 | Biermann | 29/243.521 |
| 3,601,880 | 8/1971 | Brown, Jr. | 29/243.521 X |
| 3,616,673 | 11/1971 | Miklos | 29/243.523 X |
| 3,660,885 | 5/1972 | Elflein | 29/243.523 |
| 3,906,776 | 9/1975 | Humphreys et al. | 29/243.521 X |
| 3,996,784 | 12/1976 | Champoux et al. | 29/243.522 X |
| 4,060,189 | 11/1977 | Vargo, Jr. et al. . | |
| 4,131,009 | 12/1978 | Hara et al. . | |
| 4,310,056 | 1/1982 | Olsson | 29/243.525 X |
| 4,893,394 | 1/1990 | Muller . | |
| 5,170,923 | 12/1992 | Dear et al. | 227/55 |

FOREIGN PATENT DOCUMENTS

| | | | |
|---|---|---|---|
| 0351715 | 1/1990 | European Pat. Off. . | |
| 2334385 | 1/1975 | Germany . | |
| 1128442 | 9/1968 | United Kingdom . | |
| 093081 | 11/1993 | WIPO | 29/798 |

*Primary Examiner*—Timothy V. Eley
*Assistant Examiner*—Khan V. Nguyen
*Attorney, Agent, or Firm*—Brown, Martin, Haller & McClain

[57] ABSTRACT

A fastening tool inserts a self-penetrating fastener into workpieces and then sets the fastener in a manner similar to a blind riveting tool. The fastener has a stem, a mandrel connected to the stem, and a body surrounding a portion of the stem adjacent the mandrel. The body has an enlarged head at the end opposite the mandrel. The mandrel has a point for penetrating the workpieces. The fastening tool applies a force to the fastener, causing it to penetrate the workpiece. The fastening tool then pulls the stem in a direction away from the workpiece while restraining the body against movement relative to the workpiece. The mandrel expands the lower portion of the body radially as it is pulled into contact with the body, forming a second or blind head on the side of the workpiece opposite the fastening tool.

16 Claims, 3 Drawing Sheets

FASTENING TOOL AND FASTENER

This is a continuation of application Ser. No. 08/106,439, filed Aug. 16, 1993, now abandoned.

BACKGROUND OF THE INVENTION

The present invention relates to fastening systems and, more specifically, to a system using a self-penetrating fastener for forming a riveted joint.

A nail gun is a well-known fastening tool that injects nails fed from a supply into a structural material such as wood. Nail guns are commonly powered by compressed air or electricity. Using a nail gun, a worker can easily form hundreds of nailed joints per hour.

It is often desirable to join structures that are difficult to nail, such as hard materials, fragile materials, or thin sheets of material such as sheet metal. Rivets are commonly used to fasten such materials.

Although many types of rivets are known, they can be generally grouped into two categories: pull-type or "blind" rivets, and compression-type or "drive" rivets. The fastener of the present invention is similar to a blind rivet. Blind rivets comprise a rod-shaped stem having an enlarged mandrel frangibly connected to one end and a cylindrical body enclosing a portion of the stem adjacent the mandrel. The body commonly has an enlarged flange or head at the end furthest from the mandrel.

To join workpieces using a blind rivet, a hole is drilled through the workpieces. The rivet stem is inserted into the nosepiece of a riveting tool, which firmly grasps the rivet stem. The rivet mandrel is then inserted into the hole through the workpieces so that the cylindrical portion of the body extends completely through the hole and the head rests against one of the workpieces. The riveting tool, restraining the rivet head against motion relative to the workpieces, applies a pulling force to the stem such that the mandrel, which has a slightly greater diameter than the inside diameter of the body, is pulled into the body, expanding it radially, and thereby forming an enlarged mushroom-shaped head on the "blind" side of the workpieces. The stem is then broken off from the mandrel by further pulling and is discarded.

Both portable, hand-held riveting tools and permanently mounted riveting machines suitable for production-line assembly are known. Riveting tools may be powered by compressed air or electricity.

Although riveting can form strong joints, it is a relatively slow and labor-intensive fastening method because a hole must be drilled through the workpieces before each rivet is installed. Prior art riveting methods therefore require two tools: a drill and a riveting tool. Although using two tools in an alternating fashion is inconvenient, inefficient, and uneconomical in any assembly situation, these problems are especially evident in situations where hand-held tools are used, such as in the construction industry. A worker must carry both the drill and the riveting tool as he works along large sections of metal sheathing or ductwork. Each time the worker moves to a new position, he must pick up the drill, drill a hole, put the drill down, pick up the riveting tool, install the rivet, and put the riveting tool down. Repeatedly performing these steps is tedious, tiring, and inefficient. These problems and deficiencies are clearly felt in the art and are solved by the present invention in the manner described below.

SUMMARY OF THE INVENTION

The present invention comprises a fastening tool that inserts a self-penetrating fastener into one or more workpieces to be fastened and then installs the fastener in a manner similar to a blind riveting tool. The fastener has a stem, a mandrel connected to the stem by a frangible link, and a body surrounding a portion of the stem adjacent the mandrel. The body has an enlarged flange or head at the end opposite the mandrel. The mandrel has a point for penetrating the workpieces. With the exception of the point, the fastener may have any suitable shape and may resemble any known type of blind rivet.

The fastener is oriented in a direction relative to the workpieces such that the mandrel point is adjacent to the workpieces and the stem is normal to the workpieces. A force is then applied to the fastener in a direction toward the workpieces, which are penetrated by the point. Alternatively, or in addition, a rotary force may be applied to the fastener to penetrate the workpieces in a drill-like manner. The point may have any suitable nail-like or drill-like shape to facilitate penetration and may be made of any suitable material.

When the fastener has completely penetrated the workpieces and the head of the body is adjacent one of the workpieces, the stem is pulled in a direction away from the workpieces while the body is restrained against movement relative to the workpieces. The mandrel, being slightly wider than the inside diameter of the body, expands the lower portion of the body radially as it is pulled into contact with the body. The expanded portion of the body thus forms a second or blind head on the side of the workpieces opposite the fastening tool.

When the blind head has been formed, the resistance of the mandrel to further pulling breaks the frangible link between the stem and the mandrel. The broken stem may then be ejected and discarded.

The fastening tool has a nosepiece that receives the stem of the fastener. Fasteners may be inserted into the nosepiece manually or by a suitable automatic feeding mechanism. Upon actuation, the fastening tool sequentially exerts penetration and pulling forces on the fastener, as described above. The fastening tool may generate the forces using pneumatic, hydraulic, electrical, or other suitable actuators. Alternatively, the human operator of the fastening tool may-supply the forces, either directly or via a force-amplifying mechanism such as a lever that the operator squeezes.

The fastening tool and fastener of the present invention may be used to fasten workpieces oriented in any direction. Furthermore, the fastening tool and fastener of the present invention may be used to fasten any number of workpieces if the length of the fastener body is at least as great as the combined thicknesses of the workpieces. The workpiece or workpieces may be of any shape and may be made of any material that is commonly fastened by riveting.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF THE PREFERRED EMBODIMENT

Figure 1:
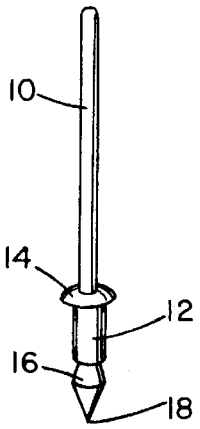
FIG. 1 illustrates a typical self-penetrating fastener.

In FIG. 1, a self-penetrating fastener comprises a stem 10, a body 12 having a head 14, and a mandrel 16 having a nail-like point 18. The point may have any suitable shape and may be made of any suitable material, such as hardened steel. The fastener may be used to join two workpieces 20 and 22, shown in FIGS. 2–3.

Figure 2:
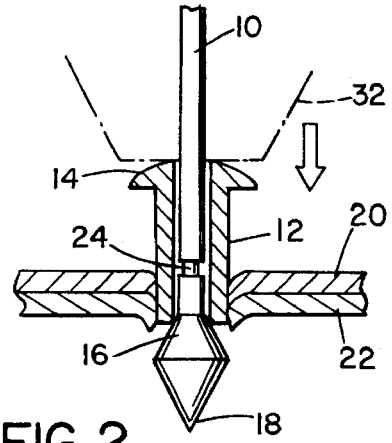
FIG. 2 is an enlarged side elevation view showing the fastener being driven through a structure.
Figure 3:
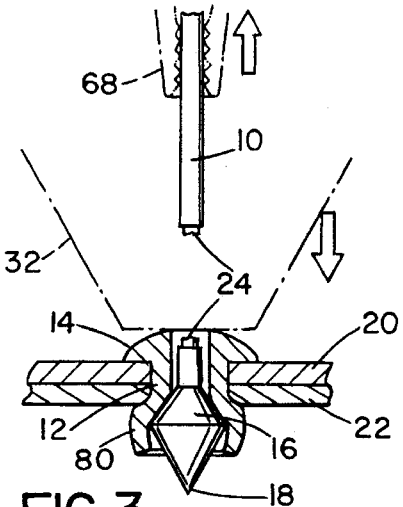
FIG. 3 is a similar view showing the setting of the fastener.

A fastening tool, portions of which are shown in phantom line in FIGS. 2–3, receives stem 10 and transmits the penetrating force to the fastener in a direction toward workpieces 20 and 22. The fastening tool applies this penetrating force until point 18 pierces workpieces 20 and 22 and head 14 contacts workpiece 20.

The fastening tool, simultaneously gripping stem 10 and restraining body 12 against movement relative to workpieces 20 and 22, applies a force to stem 10 in a direction away from workpieces 20 and 22. The force draws mandrel 16, which is slightly wider than the inside diameter of body 12, into contact with body 12, expanding it and forming a blind head adjacent to workpiece 22. When the blind head has been formed mandrel 16 resists further movement, and the pulling force breaks a frangible link 24 between stem 10 and mandrel 16, as shown in FIG. 3.

Figure 5:
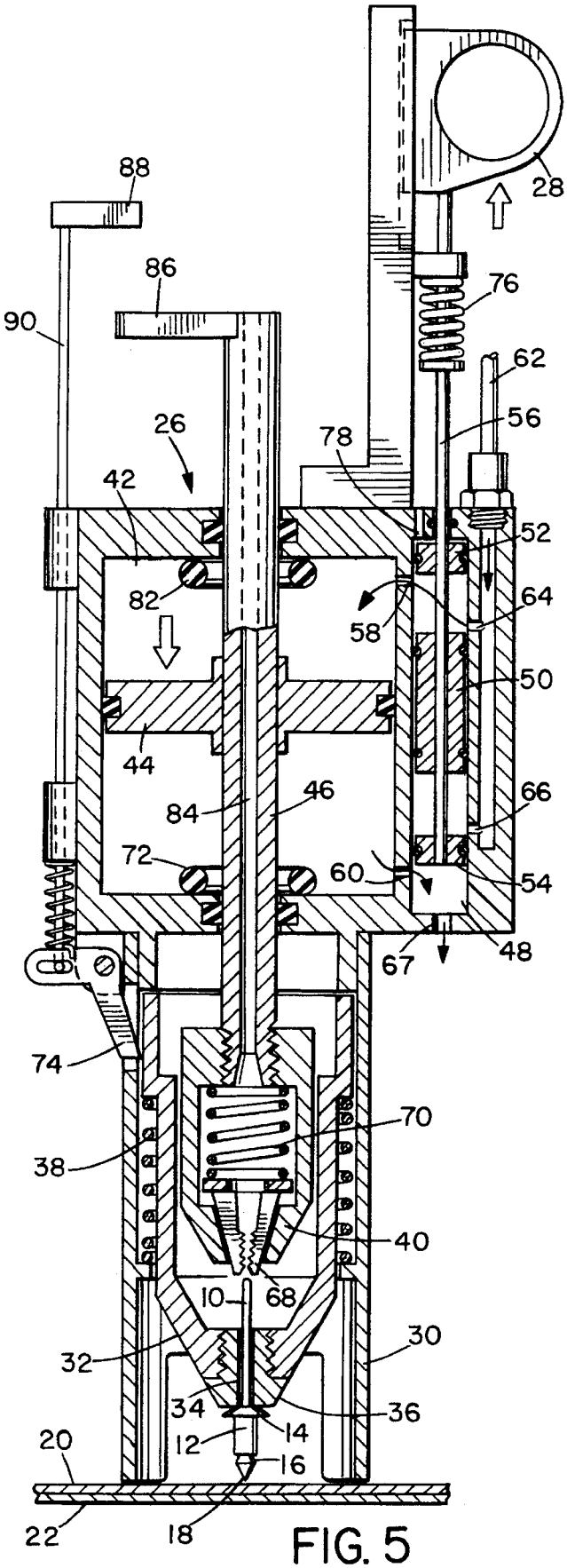
FIG. 5 is a sectional view taken along line 5—5 of FIG. 4 showing the fastening tool at the start of a fastener penetration stroke.
Figure 4:
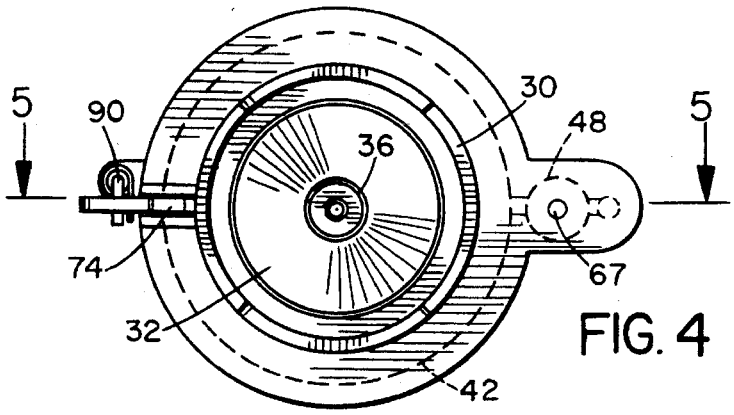
FIG. 4 is a front end view of a tool for installing the fastener.

FIGS. 5–8 illustrate the operation of the preferred fastening tool in further detail. In FIG. 5, the fastening tool is positioned for fastening workpieces 20 and 22. An actuator assembly 26 provides the penetration and pulling forces in response to the activation of a trigger 28, as described below. Actuator assembly 26 is connected to a shroud 30. During the installation of a fastener, shroud 30 is pressed firmly against workpiece 20 to enhance alignment between the fastener and the workpieces.

A nosepiece 32 inside shroud 30 has a bore 34 in its tip 36 for receiving fastener stem 10. Nosepiece 32 slides axially inside shroud 30 and is biased away from workpieces 20 and 22 by a return spring 38.

Actuator assembly 26 comprises a drive cylinder 42, a drive piston 44, a drive rod 46, a valve cylinder 48, a central valve piston 50, an upper end valve piston 52, a lower end valve piston 54, and a valve rod 56. Drive cylinder 42 has an upper drive cylinder orifice 58 and a lower drive cylinder orifice 60 connecting drive cylinder 42 to valve cylinder 48. A compressed air inlet 62 receives compressed air from a supply (not shown) and supplies it to valve cylinder 48 via an upper valve cylinder inlet orifice 64 and a lower valve cylinder inlet orifice 66. Pistons 44, 50, 52, and 54 may have O-rings for enhancing sealing.

When trigger 28 is pulled in the direction of the arrow in FIG. 5, compressed air enters valve cylinder 48 at upper valve cylinder inlet orifice 64 and exits valve cylinder 48 at upper drive cylinder orifice 58. The compressed air exerts a downward force on drive piston 44, which is transmitted to pulling head 40 via drive rod 46. The air below drive piston 44 exits drive cylinder 42 at lower drive cylinder orifice 60 and, in turn, exits valve cylinder 48 at a lower valve cylinder outlet orifice 67. Pulling head 40 moves downward and contacts nosepiece 32, urging it downward.

Pulling head 40 has means for frictionally gripping fastener stem 10, such as jaws 68. Jaws 68 are disposed in a frusto-conical recess in the end of pulling head 40. As jaws 68 descend, stem 10 enters between jaws 68. A pulling head spring 70 biases jaws 68 toward stem 10.

Figure 6:
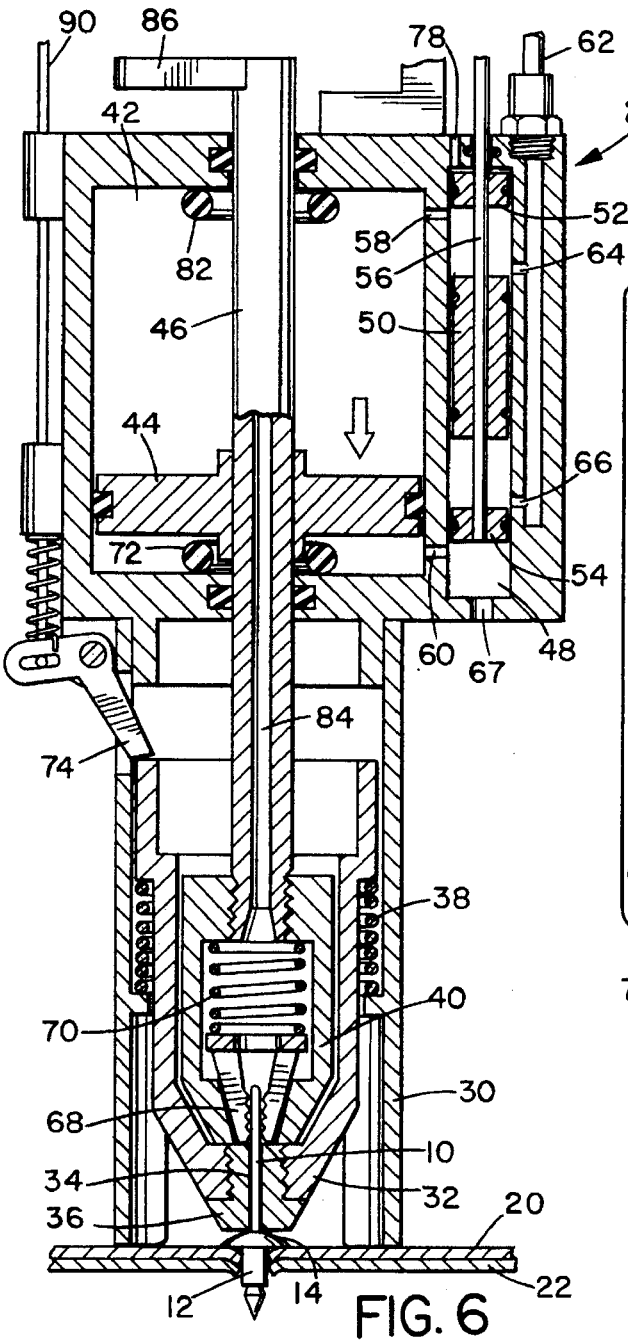
FIG. 6 is a similar sectional view showing the fastener driven through a structure.

In FIG. 6, the downward force on nosepiece 32 presses fastener point 18 against workpiece 20, piercing it and workpiece 22. The downward travel of nosepiece 32 is stopped when drive piston 44 contacts a lower drive cylinder cushioning O-ring 72. Fastener head 14 is pressed firmly against workpiece 20. A spring-biased arm 74 latches nosepiece 32 in this position.

Figure 8:
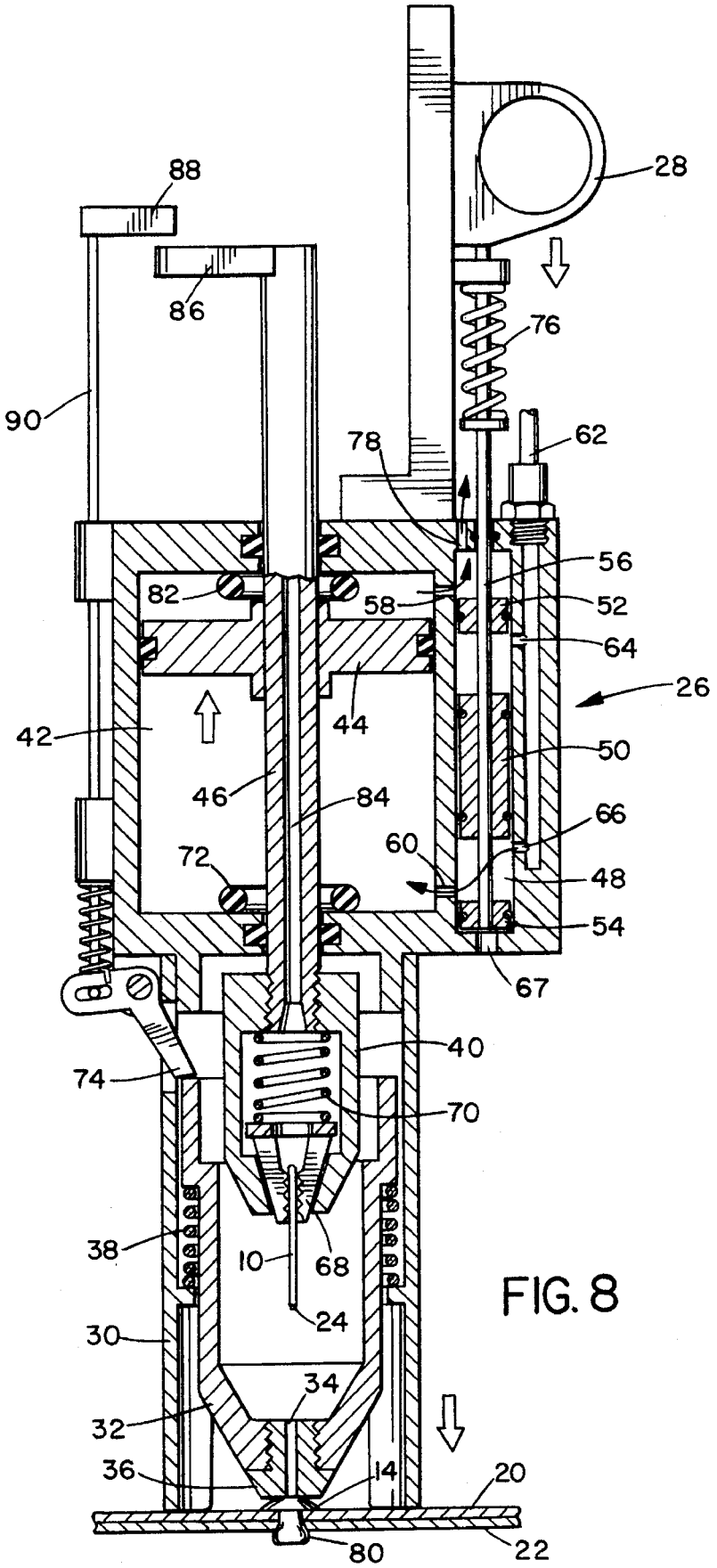
FIG. 8 is a view similar to FIG. 6, showing the fastening tool at the end of the stem pulling stroke and showing the installed fastener.

When trigger 28 is released, trigger spring 76 relaxes to urge valve rod 56 and valve pistons 50, 52, and 54 to the positions shown in FIG. 8. Compressed air enters valve cylinder 48 at lower valve cylinder inlet orifice 66 and exits valve cylinder 48 at lower drive cylinder orifice 60. The compressed air exerts an upward force on drive piston 44, which is transmitted to pulling head 40 via drive rod 46. The air above drive piston 44 exits drive cylinder 42 at upper drive cylinder orifice 58 and, in turn, exits valve cylinder 48 at an upper valve cylinder outlet orifice 78.

As pulling head 40 moves upward, jaws 68 are wedged together by the frusto-conical recess and tightly grip fastener stem 10. The upward motion of fastener stem 10 draws fastener mandrel 16 into contact with fastener body 12, as described above, and forms a blind head 80. As pulling head 40 moves further upward, fastener stem 10 breaks off because the remainder of the fastener is restrained against movement by nosepiece 32, which is latched in place. The upward travel of pulling head 40 is stopped when drive piston 44 contacts an upper drive cylinder cushioning O-ring 82. Although cushioned by O-ring 82, the impact is sufficient to unwedge jaws 68 slightly, thereby releasing their grip on fastener stem 10. Once fastener stem 10 is released, its momentum propels it through a bore 84 in drive rod 46 where it is ejected from the fastening tool.

Spring-biased arm 74 is released when drive piston 44 and pulling head 40 reach their uppermost positions. A drive rod arm 86 on the upper end of drive rod 46 contacts a latch release arm 88 on the end of a pushrod 90, which is connected to spring-biased arm 74. The movement of spring-biased arm 74 unlatches nosepiece 32, and return spring 38 urges nosepiece 32 upward to the position shown in FIG. 5. A new fastener may then be inserted into nosepiece 32 and the sequence repeated.

Although the operation of the fastening tool is described above with respect to workpieces oriented in a horizontal plane, it should be noted that the fastening tool and fastener of the present invention may be used to fasten workpieces oriented in any direction. Furthermore, although two workpieces are shown for illustrative purposes, the fastening tool and fastener of the present invention may be used to fasten any number of workpieces if the length of the fastener body is at least as great as the combined width of the workpieces.

Figure 7:
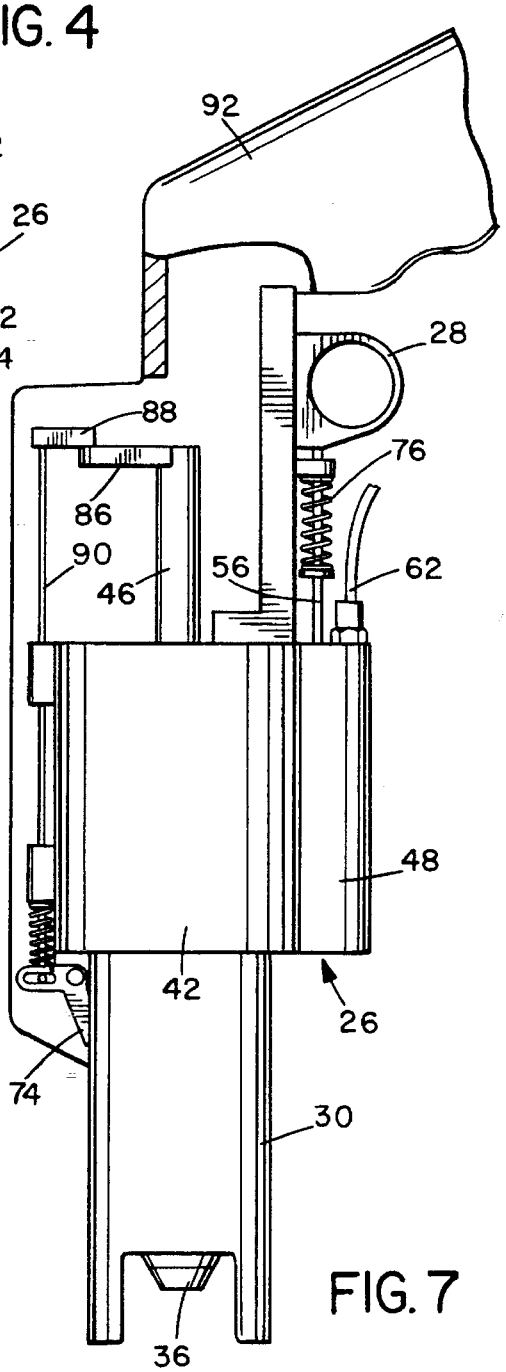
FIG. 7 is a reduced side elevation view of the fastening tool with a typical hand grip attached.

As shown in FIG. 7, the fastening tool may be enclosed in a suitable housing, and may include a hand grip 92 for facilitating use of trigger 28 by an operator (not shown). However, in other embodiments actuator assembly 26 may be controlled electronically or electromechanically rather than by a manually operated trigger.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

We claim:

1. A self-penetrating fastening apparatus for installing in a workpiece a fastener having a fastener stem, a point for piercing said workpiece, and a fastener body surrounding a portion of said fastener stem, comprising:

a nosepiece having an end for contacting said fastener and a hollow bore for receiving said fastener stem;

a pulling head axially movable with respect to said nosepiece having grip means for frictionally engaging said fastener stem and retaining said fastener stem; and an actuator for applying an axial penetrating force to said nosepiece, said nosepiece carrying said point into contact with said workpiece for piercing said workpiece solely in response to said axial penetrating force, until said fastener body extends into said workpiece, said actuator adapted to drive said pulling head in an axial direction toward said workpiece for urging said grip means into frictional engagement with said fastener stem and for applying a pulling force to said grip means in a direction away from said workpiece while said nosepiece restrains said fastener body against movement relative to said workpiece.

2. The fastening apparatus described in claim 1, wherein said penetrating force has a direction toward said workpiece.

3. The fastening apparatus described in claim 2, wherein:

said nosepiece has a hollow cylindrical portion; and said pulling head is disposed within said hollow cylindrical portion of said nosepiece.

4. The fastening apparatus described in claim 3, wherein said pulling head moves in a direction toward said workpiece and contacts said nosepiece for urging said nosepiece toward said workpiece in response to said penetrating force.

5. The fastening apparatus described in claim 2, wherein said actuator comprises:

a drive cylinder having first and second drive cylinder orifices;

a drive rod axially movable relative to said drive cylinder; and a drive piston disposed in said drive cylinder and connected to said drive rod between said drive cylinder orifices.

6. The fastening apparatus described in claim 5, wherein said actuator further comprises:

a valve cylinder having a first valve cylinder orifice in pneumatic communication with said first drive cylinder orifice, a second valve cylinder orifice in pneumatic communication with said second drive cylinder orifice, third and fourth valve cylinder orifices for receiving pressurized air, and fifth and sixth valve cylinder orifices for releasing air from said valve cylinder;

a valve rod axially movable relative to said valve cylinder; and first and second valve end pistons disposed in said valve cylinder and attached to said valve rod;

a central valve piston disposed in said valve cylinder and attached to said valve rod between and spaced from said first and second valve end pistons;

said first and third valve cylinder orifices are in pneumatic communication and said second and sixth valve cylinder orifices are in pneumatic communication when said valve rod is in a first position; and said second and fourth valve cylinder orifices are in pneumatic communication and said first and fifth valve cylinder orifices are in pneumatic communication when said valve rod is in a second position.

7. The fastening apparatus described in claim 6, wherein said actuator further comprises a manually operated trigger connected to said valve rod for moving said valve rod between said first and second positions.

8. The fastening apparatus described in claim 2, wherein said grip means comprises jaws.

9. The fastening apparatus described in claim 8, wherein said pulling head has a frusto-conical opening, and said jaws are disposed in said opening.

10. The fastening apparatus described in claim 9, wherein said jaws release said fastener stem after said fastener has been installed in said workpiece.

11. The fastening apparatus described in claim 5, wherein said drive rod has a longitudinal bore for passing a released fastener stem therethrough.

12. The fastening apparatus described in claim 5, wherein said drive rod is connected to said pulling head.

13. The fastening apparatus described in claim 12, further comprising a shroud connected in rigid relation to said drive cylinder and partially enclosing said nosepiece, said shroud having an end for placing in contact with said workpiece.

14. The fastening apparatus described in claim 13, further comprising a nosepiece return spring between said shroud and said nosepiece for biasing said nosepiece away from said workpiece.

15. The fastening apparatus described in claim 14, further comprising a latch rigidly mounted with respect to said actuator for preventing said nosepiece from moving in a direction away from said workpiece until after said fastener has been installed in said workpiece.

16. The fastening apparatus described in claim 15, wherein a portion of said drive rod contacts a portion of said latch for releasing said latch when said grip means has moved away from said workpiece to a retracted position.

* * * * *

UNITED STATES PATENT AND TRADEMARK OFFICE

CERTIFICATE OF CORRECTION

PATENT NO. : 5,469,610

DATED : NOVEMBER 28, 1995

INVENTOR(S) : CURTIS C. COURIAN AND KENNETH J. COURIAN

It is certified that error appears in the above-indentified patent and that said Letters Patent is hereby corrected as shown below:

_ COLUMN 5, LINE 15, DELETE "SELF-PENETRATING;" AND

_ COLUMN 5, LINE 16, BEFORE "FASTENER" (FIRST OCCURRENCE), INSERT --SELF-PENETRATING--.

Signed and Sealed this

Seventh Day of May, 1996

*Attest:*

*Attesting Officer*

BRUCE LEHMAN

*Commissioner of Patents and Trademarks*